US005593094A

United States Patent [19]

Barriac et al.

[11] Patent Number: 5,593,094

[45] Date of Patent: Jan. 14, 1997

[54] PUMP SPRAYER HAVING VARIABLE DISCHARGE

[75] Inventors: Jacques J. Barriac, Claremont; R. Pat Grogan, Downey, both of Calif.

[73] Assignee: Calmar Inc., City of Industry, Calif.

[21] Appl. No.: 385,133

[22] Filed: Feb. 7, 1995

[51] Int. Cl.[6] ..... B05B 1/34

[52] U.S. Cl. ..... 239/476; 239/477; 239/490

[58] Field of Search ..... 239/461, 463, 239/476–479, 490, 401, 402.5, 403, 406

[56] References Cited

U.S. PATENT DOCUMENTS

| | | | |
|---|---|---|---|
| 3,061,202 | 10/1962 | Tyler . | |
| 3,762,647 | 10/1973 | Tada | 239/476 |
| 3,840,157 | 10/1974 | Hellenkamp | 222/309 |
| 3,995,774 | 12/1976 | Cooprider et al. . | |
| 4,161,288 | 7/1979 | McKinney | 239/333 |
| 4,174,069 | 11/1979 | Grogan . | |
| 4,189,064 | 2/1980 | O'Neill et al. . | |
| 4,358,057 | 11/1982 | Burke . | |
| 4,767,060 | 8/1988 | Shay | 239/401 |
| 5,397,060 | 3/1995 | Maas | 239/333 |

FOREIGN PATENT DOCUMENTS

| | | | |
|---|---|---|---|
| 1119657 | 6/1956 | France | 299/136 |

*Primary Examiner*—Robert J. Oberleitner
*Assistant Examiner*—C. T. Bartz
*Attorney, Agent, or Firm*—Watson Cole Stevens Davis

[57] ABSTRACT

A pump sprayer has a hinged nozzle cap assembly for shifting the spray mechanics away from a spinner probe to adjust a fine mist spray from a full divergent spray cone to a less divergent spray cone.

18 Claims, 2 Drawing Sheets

31
2
15
16
33
21
17
24
26
2
32
29
28
14
27
13
25
10
11

31
16
22
22
21
19
26
26
22
17

15
16
13
24
18
25
31
36
17
33
22
34
19
23
10
14
27
12
11

A
31
25
24
32
33
15
21
13
34
14
23
10
27
16
12
11

PUMP SPRAYER HAVING VARIABLE DISCHARGE

BACKGROUND

The invention relates generally to a fingertip operated pump sprayer having a nozzle cap surrounding a spinner probe on the pump plunger, the cap having spin mechanics cooperating with an end of the probe to effect a spray discharge of a given conicity upon pump operation.

More particularly, the invention relates to such a pump sprayer in which the nozzle cap is hinge-mounted to the pump plunger, for moving the spin mechanics away from the end of the probe to reduce the spin velocity, thereby varying the fluid spray pattern.

Known pump sprayers, such as that exemplified by U.S. Pat. Nos. 3,061,202, 3,995,774, and 4,358,057 have rotatable spray nozzles capable of being adjusted between spray and stream positions as the spin mechanics is adjusted to either impart a swirl to the discharged fluid or is adjusted allowing the discharged fluid to bypass the fluid spin mechanics.

Such prior art adjustable sprayers have their limitations, as they require manual rotation of the nozzle cap which may give rise to additional costs of production. Besides, the rotatable nozzle cap, especially for fingertip sprayers of relatively small size, is cumbersome to operate because the nozzle cap must be manipulated by the user, which could create problems for the user in the handling of the dispensing package.

Known pump sprayers such as the type shown by U.S. Pat. No. 4,189,064, commonly owned herewith, have spin mechanics formed on the inner face of the nozzle cap confronting the spinner probe for imparting a spin or swirl to the fluid at a given velocity to issue through the discharge orifice as a fine mist spray which breaks up in the atmosphere in the form of a divergent spray cone of a given size. Such spin mechanics includes a spin chamber co-axial with the discharge orifice, and tangential channels leading into the spin chamber. Longitudinal channels on the inner face of the cap skirt leading to the tangentials establish a flow path from the discharge passage formed in the hollow piston stem. The plunger head includes the spinner probe, and the nozzle cap is mounted on the plunger for reciprocation together therewith, upon manual depression of the head.

It is desirable for certain applications to provide a narrower spray cone which may approach that of a stream discharge using the existing nozzle cap structure, the less divergent spray cone satisfying the need for reducing the area of spray against a target of a given size to be wetted during pumping operation. It would be beneficial to selectively vary the size of the spray cone in a simple and economical manner without introducing complicated retooling, production and assembly costs, while maintaining the number of molded parts at a minimum.

SUMMARY OF THE INVENTION

It is therefore an object of the present invention to provide an improved pump sprayer capable of adjustment by the operator to effect the discharge of product both as a full fine mist spray as well as a spray having a less divergent, narrower spray plume, by directing the fluid flow in a manner as to bypass at least some of the effect of the tangentials leading into the spin chamber, without the need to operate a rotatable nozzle cap or the like.

This general objective is carried out by hinging the nozzle cap to the plunger head to permit movement of the spin mechanics away from the end of the probe for negating at least some of the spin velocity at the spin chamber to produce a spray having a less divergent, narrower spray cone.

A cover plate or the like may be provided for the nozzle cap, the plate overlying the top of the plunger head for easy manipulation by the operator in adjusting the spray. The external face of the skirt of the nozzle cap sealingly engages an annular bore in the plunger head such that upon hinged movement of the cap from a first unadjusted position to a second adjusted position for effecting a less divergent spray cone, the cap skirt is distorted for spring tensioning the cover plate in the second adjusted position. The cover plate cooperates with limit stops on the plunger head in both first and second positions for limiting the forward hinged movement of the cover plate in the second adjusted position, and to provide snap-fit engagement of the cover plate in its unadjusted position.

In the unadjusted position, the sprayer is actuated for spraying product in a given, wide divergent spray plume, by the application of a downward finger force on the head.

To produce a less divergent spray, the operator simply shifts to cover plate forwardly about its hinge and presses downwardly on the adjusted cover plate.

In one embodiment of the invention, the spinner probe is generally cylindrical, there being a fluid path established between the probe and the surrounding oversized cap skirt, the fluid path establishing communication with the discharge passage, as in known designs.

In accordance with another embodiment of the invention, the spinner probe is frusto-conical, with its free end being of smaller diameter compared to that of its root end. The cap skirt is of complementary conical shape, which snugly embraces the conical probe in the first adjusted position. The cap skirt has internal longitudinal grooves, establishing the fluid flow path from the discharge passage to the spin mechanics tangentials. Upon hinged movement of the spray mechanics away from the free end of the conical probe, at least a portion of the inner surface of the nozzle skirt disengages the conical probe, thereby permitting the fluid flow to bypass at least some of the effect of the tangentials to thereby produce a narrower spray cone, as in the first embodiment. However, due to the conicity of the spinner probe and the surrounding nozzle cap skirt, the spin mechanics must be moved a greater distance away from the free end of the probe to effect this bypass of the tangentials, compared to the rather slight movement of the spin mechanics away from the free end of the cylindrical spinner probe as in the first embodiment. Thus, due to the geometry of the spinner probe and surrounding nozzle cap skirt of the second embodiment, a coarser hinged adjustment is permitted which provides an advantage to the user in better controlling and manipulating the hinged adjustment.

Other objects, advantages and novel features of the invention will become more apparent from the following detailed description of the invention when taken in conjunction with the accompanying drawings.

DETAILED DESCRIPTION OF THE INVENTION

Figure 1:
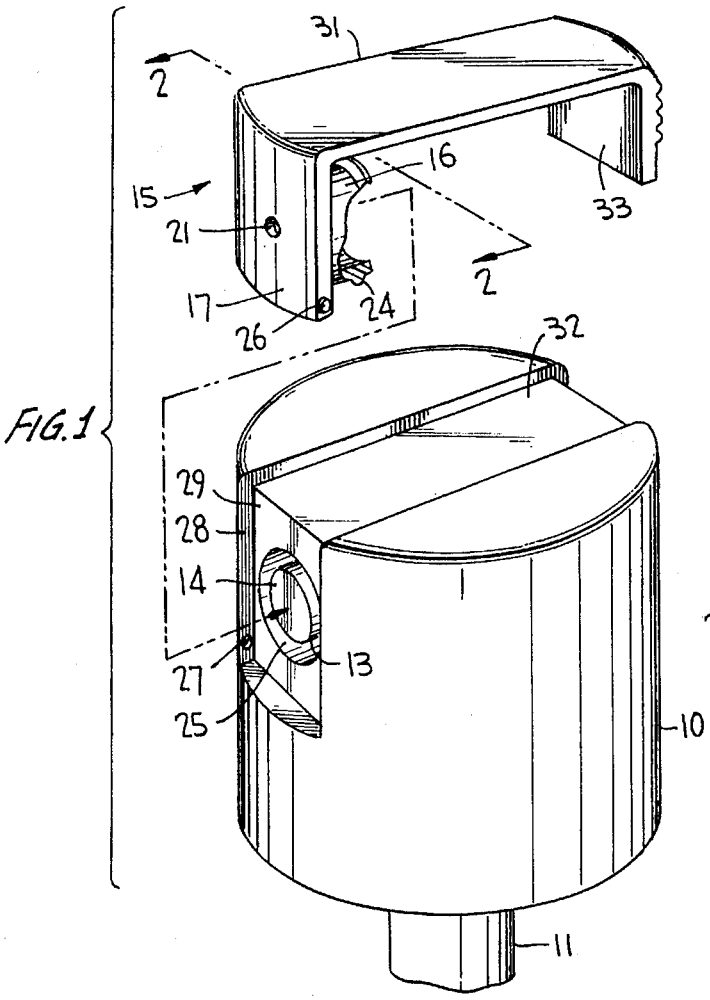
FIG. 1 is a perspective, exploded view of a plunger head for a pump sprayer incorporating one embodiment of the invention.
Figure 3:
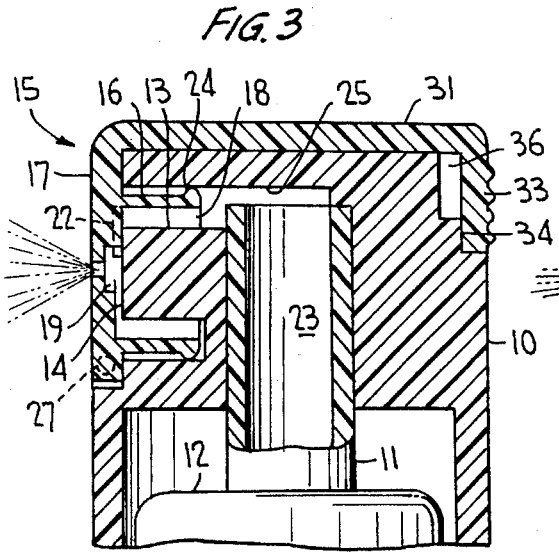
FIG. 3 is a vertical sectional view of FIG. 1, showing the nozzle cap in its unadjusted, first position for effecting the discharge of a standard spray plume.
Figure 4:
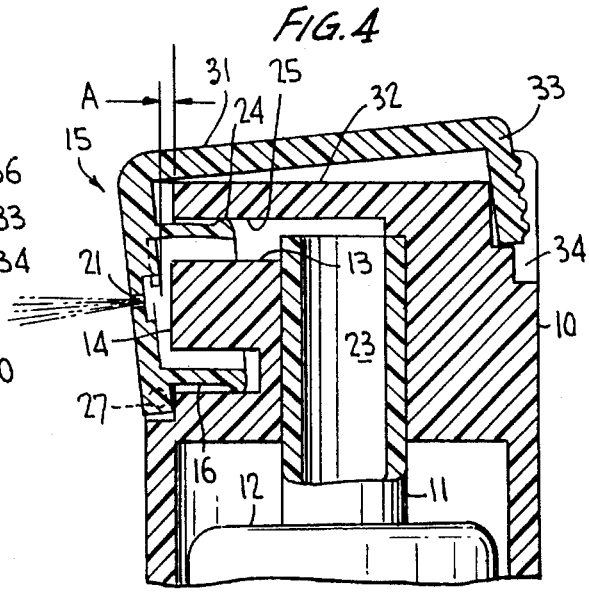
FIG. 4 is a view similar to FIG. 3, showing the nozzle cap in its adjusted, second position, for effecting the discharge of product having a less divergent spray plume.

Turning now to the drawings, wherein like reference characters refer to like and corresponding parts throughout the several views, a portion of the pump sprayer according to the invention is shown in FIGS. 1, 3 and 4 according to one embodiment of the invention, as including a plunger head 10 mounted on the upper end of a hollow piston stem 11 which reciprocates within a pump cylinder (not shown) mounted on a container (not shown) of product to be dispensed by the provision of a closure 12, the crown portion of which is partially shown in FIGS. 3 and 4. The piston-cylinder pump operation and structure is similar to that shown in U.S. Pat. No. 4,189,064, the disclosure of which being specifically incorporated herein by reference.

The plunger head includes a transversely extending spinner probe 13 of generally cylindrical configuration, having an end wall 14. A nozzle cap assembly, generally designated 15, includes a cap skirt 16 extending from a front wall 17, the skirt surrounding the spinner probe and forming together therewith an annular fluid path 18.

Figure 2:
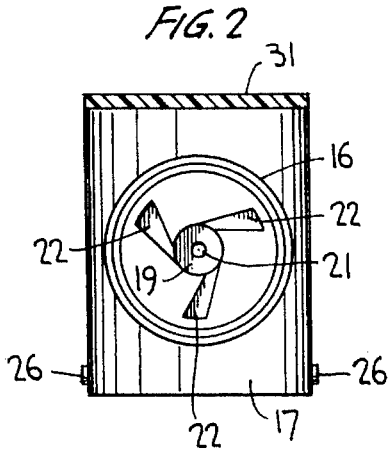
FIG. 2 is a view taken substantially along the line 2—2 of FIG. 1.

The wall 17 has formed at its inner face spin mechanics generally of the type disclosed in the U.S. Pat. No. 4,189,064 and shown in FIG. 2 hereof as including a circular depression 19 coaxial with discharge orifice 21, and a plurality of tangential groves 22 communicating with depression 19. In the FIG. 3 position end wall 14 of probe 13 bears against the inner face of wall 17 to thereby close circular depression 19 forming a spin chamber. Also, in such position grooves are closed to form tangential channels connecting the spin chamber with fluid path 18 which in turn communicates with discharge passage 23 formed by the hollow piston stem.

Skirt 16 has an external annular seal bead 24 in engagement in the first position of the nozzle cap of FIG. 3 with an annular bore formed in the plunger head defining a cylindrical surface 25.

According to the invention, the nozzle cap assembly is hinged to the plunger head via its front wall 17, at the lower end thereof, by the provision of small protrusions 26 (FIG. 2) which may be snap-fitted into corresponding dimples 27 formed within the opposing front edges 28 of a cutout 29 which may be formed at the front face of the plunger head, as shown in FIG. 1. The thickness of front wall 17 is substantially equal to the depth of cutout 29, and the contour of wall 17 is substantially the same as the cylindrical contour of the plunger head such that, in the FIG. 3 position, front wall 17 is flush with the overall contour of the plunger head.

The nozzle cap assembly further includes a cover plate 31 extending rearwardly of front wall 17, the plate having a thickness permitting it to fit within a cutout 32 formed in the upper wall of the plunger head, cutout 32 having a depth substantially equal to the thickness of plate 31 so that, in the FIG. 3 position, the cover plate is flush with the top wall of the plunger head.

The cover plate may have a depending flange 33 engageable with the plunger head at undercut 34 located in the head. The undercut, the length of the cover plate 31, and the extent of flange 33 are of such dimension as to draw the inner face of front wall 17 against end wall 14 of the spinner probe, as shown in FIG. 3.

In operation, the user simply applies external, downward finger force against the outer surface of plate 31 for pumping product from the primed pump chamber (not shown) of the pump sprayer through its discharge orifice during each pumping stroke in the form of a wide, divergent spray cone as a spin is imparted to the fluid by the tangentials before exiting the discharge orifice. In the first, unadjusted position of the nozzle cap, shown in FIG. 3, the pump spraying operation is the same as in any known fine mist sprayer.

For adjusting the spray to effect a less divergent spray discharge, the operator simply pushes up on flange 33, which may be externally knurled as at 35 for this purpose, until the flange snaps into undercut 36 which is stepped in relation to undercut 34 as shown. An upward pressing movement applied against flange 33 pivots the nozzle cap assembly about hinge 26, 27 to thereby shift the inner face of wall 17 containing the spin mechanics a distance A away from the front end of the probe, as shown in FIG. 4. In this position, the skirt seal bead 24 remains sealingly engaged with cylindrical surface 25, and skirt 16 slightly distorts as it moves through an arc such that the distorted cap skirt imparts resilience to the pivoted cap assembly and effects a spring-locking of flange 33 within its cut out 36.

Upon actuation of the plunger head as before, in the FIG. 4 adjusted or second position of the nozzle cap assembly, the spin which would otherwise be imparted to the fluid which moves downstream of end wall 14 is negated as the tangential channels are now open by essentially the distance A. The spin velocity of the fluid is therefore reduced such that discharge through the orifice takes the form of a less divergent spray cone.

The nozzle cap assembly may be simply returned to its unadjusted position of FIG. 3 as the operator presses rearwardly against the upper portion of front wall 17.

In accordance with another embodiment to the invention, shown in FIGS. 5–8, the pump sprayer is essentially the same as in the FIGS. 1–4 embodiment, except that spinner probe 37 is frustoconical, end wall 14 of the probe having a smaller diameter compared to its root end. The conical angle may, for example, be about 15° relative to the central axis of the probe.

Cap skirt 38, shown in the second embodiment, is of conical shape which matches that of probe 37. The skirt has an annular seal bead 24 in sealing engagement with annular surface 25 of the head in both the FIGS. 5 and 6 positions of the nozzle cap assembly. And, as most clearly shown in FIGS. 7 and 8, inner surface 39 of cap skirt 38 is provided with one or more longitudinal grooves 41 which establish fluid path 18 communicating the tangentials of the spin chamber with discharge passage 23.

Figure 5:
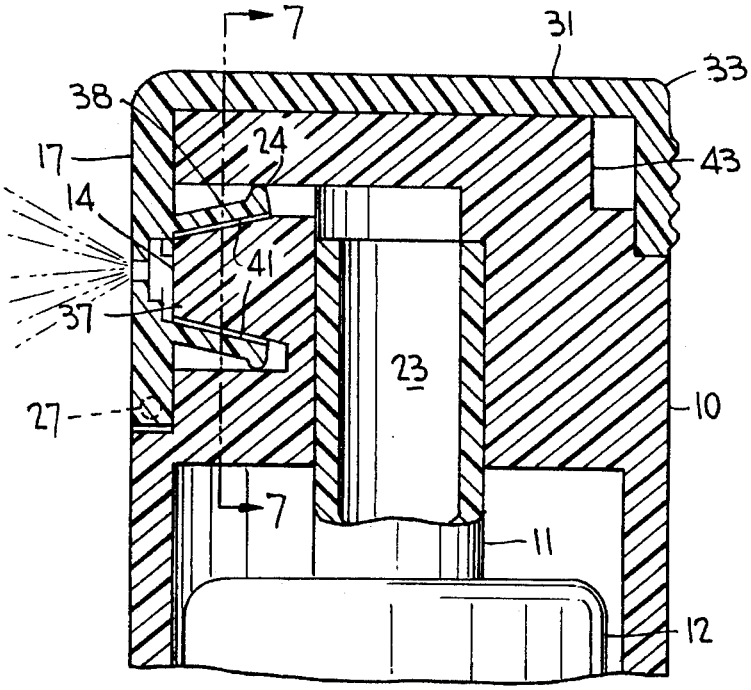
FIG. 5 is a vertical sectional view similar to that of FIG. 3 of another embodiment of the invention, showing the nozzle cap in its first, unadjusted position for effecting the discharge in a normal spray plume.
Figure 7:
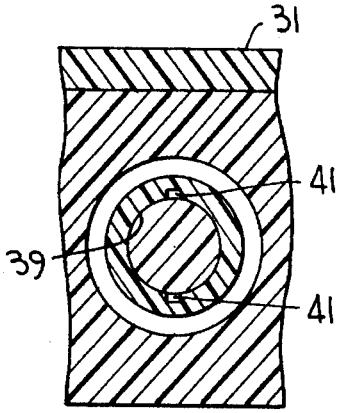
FIG. 7 is a sectional view taken substantially along the line 7—7 of FIG. 5.

In the FIG. 5 mode, the pump sprayer is operated as in any normal manner, such that during each pressure stroke as external, downward finger force is applied against the top of cover plate 31 of the plunger head, product issues through the discharge orifice as a standard divergent spray cone.

Figure 6:
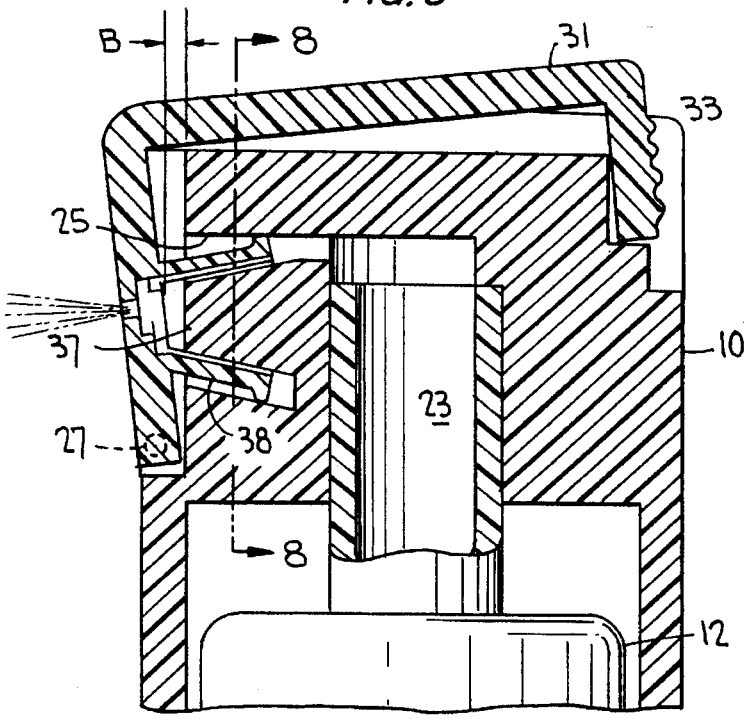
FIG. 6 is a view similar to FIG. 5, showing the nozzle cap in its adjusted, second position for effecting the discharge of spray in a less divergent spray plume.
Figure 8:
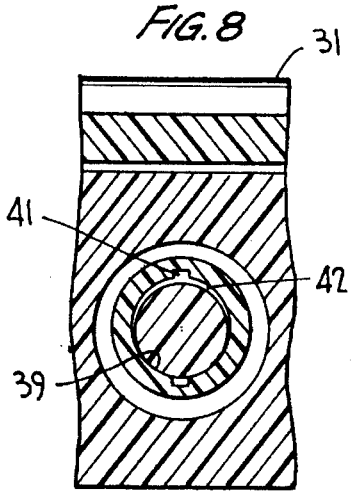
FIG. 8 is a view taken substantially along the line 8—8 of FIG. 6.

In the adjusted or second position of the nozzle cap assembly shown in FIG. 6, the lower end of front wall 17 pivots about axis 26, 27 whereupon cap skirt 38 becomes distorted and the upper portion of the cap skirt disengages from probe 37 to present a gap 42, as shown in FIG. 8. However, in order to effect an open gap 42 for establishing a fuller fluid path analogous to the fluid path of the FIGS. 1–4 embodiment, the nozzle cap assembly must be pivoted a greater amount such that distance at B shown in FIG. 6 is greater than the corresponding distance A shown in FIG. 4. In the FIG. 6 adjusted position of the nozzle cap assembly, product flowing through the wider opened fluid path (defined by grooves 41 and gap 42) is subjected to a reduced velocity by the tangentials, such that the fluid exits the discharge orifice as a less divergent spray cone, similarly as described with reference to FIG. 4.

To achieve a greater separation distance B, undercut 43 is deeper in a transverse direction compared to that of undercut 36 of the FIGS. 1–4 embodiment. Thus, when the operator pushes up on flange 33 to shift the same from undercut 34 to undercut 43, front wall 17 of the nozzle cap assembly pivots a greater distance compared to that of FIG. 4, which provides an advantage to the user, as it is more convenient when handling a relatively small-sized pump sprayer package to pivot the nozzle cap assembly forward a greater distance rather than a smaller one to effect the same reduction in divergent spray. The pivoting of the nozzle cap assembly according to the FIGS. 5–8 embodiment is easy to control and manipulate by the operator.

In the FIG. 6 adjusted position, the operator simply depresses the plunger for spraying as in any normal manner, and, to return to the full spray mode of FIG. 5, the operator simply presses against the upper portion of the front wall 17 in a rearward direction.

As in the FIGS. 1–4 embodiment, the cap skirt 38 which becomes distorted upon adjusted movement of the nozzle cap assembly shown in FIG. 6, effects a stored spring force which functions to spring lock flange 33 within undercut 43.

Obviously, many other modifications and variations of the present invention are made possible in the light of the above teachings. It is therefore to be understood that within the scope of the appended claims the invention may be practiced otherwise than as specifically described.

What is claimed is:

1. A pump sprayer having a reciprocable hollow piston stem defining a fluid discharge passage, a plunger head mounted on said stem and having a probe extending transversely from said stem, a nozzle cap assembly including a nozzle cap surrounding said probe, said cap having a discharge orifice and means including a spin chamber in communication with said orifice for imparting a spin at a given velocity to fluid to be discharged through said orifice as a fine mist spray of a given discharge spray pattern in a first position of said cap, a fluid path defined between said head and said nozzle cap and extending from said passage to said orifice via said spin imparting means, the improvement wherein:

said nozzle cap assembly is hinged to said plunger head for movement of said spin imparting means a given distance away from a free end of said probe to a second position for negating the spin imparted to the fluid for varying the discharge spray pattern, said assembly having a cover plate overlying said plunger head to facilitate the hinged movement between said first and second positions.

2. The sprayer according to claim 1, wherein said cover plate engages said plunger head for locking said plate in each of said first and second positions.

3. The sprayer according to claim 1, wherein said probe is cylindrical having a flat tip.

4. The sprayer according to claim 1, wherein said probe is frusto-conical having a flat tip of smaller diameter compared to a root end thereof.

5. The sprayer according to claim 4, wherein said nozzle cap assembly has a cap skirt of conical shape matching that of said probe, an inner surface of said cap skirt having longitudinal grooves defining said fluid path, said inner surface engaging said probe in said first position, and at least a portion of said inner surface disengaging said probe in said second position upon the movement of said nozzle cap a distance greater than said given distance.

6. The sprayer according to claim 5, wherein said nozzle cap assembly has an extension engageable with said plunger head for locking said extension in each of said first and second positions.

7. The sprayer according to claim 6, wherein said extension comprises a cover plate overlying said plunger head.

8. A pump sprayer comprising:

a hollow piston stem reciprocable within a container closure and defining a fluid discharge passage;

a plunger head on said stem having fluid spray means defining a fluid path extending from said passage to said spray means;

said spray means including a spinner probe and a nozzle cap assembly including a nozzle cap surrounding said probe, said cap having a front wall including fluid spin mechanics cooperating with an end wall of said probe to define a spin chamber and tangential channels communicating with said fluid path in a relaxed first position of said cap to produce a fluid spray pattern at a given spin velocity said front wall bearing against said end wall in said first position;

said front wall of said nozzle cap assembly being hinged to said plunger head for pivotal movement of said spin mechanics to open said spin chamber and said channels a given distance from said end wall of said probe to a second position for reducing the spin velocity to thereby vary the fluid spray pattern.

9. The sprayer according to claim 8, wherein said nozzle cap assembly has means to facilitate the manual movement.

10. The sprayer according to claim 9, wherein an outer end of said nozzle cap sealingly engages said plunger head in said first and second positions, said cap being distorted for spring tensioning said cap in said second position.

11. The sprayer according to claim 10, wherein said cap assembly means comprises a cover plate overlying said plunger head for movement between said first and second positions.

12. The sprayer according to claim 11, wherein said cover plate engages said plunger head for spring locking said plate in each of said first and second positions.

13. The sprayer according to claim 8, wherein said spinner probe is cylindrical.

14. The sprayer according to claim 8, wherein said spinner probe is frusto-conical, said free end having a smaller diameter compared to a root end thereof.

15. The sprayer according to claim 14, wherein said nozzle cap comprises a skirt of conical shape snugly embracing said probe in said relaxed first position, an inner surface of said skirt having longitudinal grooves defining said fluid path, and at least a portion of said inner surface disengaging said probe in said second position upon the movement of said nozzle cap assembly a distance greater than said given distance.

16. The sprayer according to claim 15, wherein an outer end of said skirt sealingly engages said plunger head in said first and second positions, said skirt being spring tensioned by said plunger head during movement between said first and second positions.

17. The sprayer according to claim 16, wherein said nozzle cap includes a cover plate engaging said plunger head for spring locking said plate in each of said first and second positions.

18. A pump sprayer having a reciprocable hollow piston stem defining a fluid discharge passage, a plunger head mounted on said stem and having a probe extending transversely from said stem, a nozzle cap assembly including a nozzle cap surrounding said probe, said cap having a front wall including a discharge orifice and means cooperating with an end wall of said probe in a first position of said cap for imparting a spin at a given velocity to fluid to be discharged through said orifice as a fine mist spray of a given discharge spray pattern, said front wall bearing against said end wall of said probe in said first position of said cap, a fluid path defined between said head and said nozzle cap and extending from said passage to said orifice via said spin imparting means, the improvement wherein:

said front wall of said nozzle cap assembly is hinged to said plunger head for movement a given distance away from said end wall of said probe to a second position for opening said spin imparting means so as to negate the spin imparted to the fluid for varying the discharge spray pattern.

* * * * *